US009335059B2

(12) United States Patent
Cho et al.

(10) Patent No.: US 9,335,059 B2
(45) Date of Patent: May 10, 2016

(54) CEILING TYPE AIR CONDITIONER

(71) Applicant: LG Electronics Inc., Seoul (KR)

(72) Inventors: Namjoon Cho, Seoul (KR); Kyungrock Kim, Seoul (KR); Dongkeun Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 253 days.

(21) Appl. No.: 14/049,653

(22) Filed: Oct. 9, 2013

(65) Prior Publication Data

US 2014/0234138 A1 Aug. 21, 2014

(30) Foreign Application Priority Data

Feb. 21, 2013 (KR) ..... 10-2013-0018656

(51) Int. Cl.

| | |
|---|---|
| ***F24F 7/06*** | (2006.01) |
| ***F24F 1/00*** | (2011.01) |
| ***F04D 25/08*** | (2006.01) |
| ***F04D 25/06*** | (2006.01) |

(52) U.S. Cl.

CPC ..... *F24F 1/0007* (2013.01); *F04D 25/0653* (2013.01); *F04D 25/082* (2013.01); *F24F 1/0022* (2013.01); *F24F 2001/0037* (2013.01)

(58) Field of Classification Search

CPC F24F 1/0007; F24F 1/0022; F24F 2001/0037
USPC ..... 417/366, 369, 423.8
See application file for complete search history.

(56) References Cited

U.S. PATENT DOCUMENTS 7,066,712 B2 * 6/2006 Kim et al. ..... 415/58.4

* cited by examiner

*Primary Examiner* — Peter J Bertheaud
(74) *Attorney, Agent, or Firm* — Dentons US LLP

(57) ABSTRACT

A ceiling type air conditioner includes a case defining an outer appearance, a fan disposed to a bottom of the case, a turbo fan disposed within the case, the turbo fan including a main plate rotated by power provided from the fan motor and a blade having a side connected to the main plate, and a heat exchanger disposed outside the turbo fan. A cooling passage cooling the fan motor is defined between the main plate and the bottom surface of the case. The cooling passage includes a flow part through which air passing through the blade flows into the flow part toward the fan motor, and a panel installation part to which a panel is installed for adjusting an amount of air flowing into the flow part toward the fan motor.

15 Claims, 6 Drawing Sheets

Related Art

CEILING TYPE AIR CONDITIONER

CROSS-REFERENCE TO RELATED APPLICATIONS

The present application claims priority under 35 U.S.C. 119 and 35 U.S.C. 365 to Korean Patent Application No. 10-2013-0018656 (filed on Feb. 21, 2013), which is hereby incorporated by reference in its entirety.

BACKGROUND

The present disclosure relate to a ceiling type air conditioner.

In general, ceiling type air conditioners are devices that are positioned in an indoor ceiling to discharge heat-exchanged air into an indoor space after suctioning indoor air from the ceiling. In such a ceiling type air conditioner, air is suctioned through a suction hole defined in a central portion of the ceiling type air conditioner, and then, the suctioned air is heat-exchanged by a heat exchanger disposed within the ceiling type air conditioner. The air-conditioned air may be discharged into the indoor space through a discharge part disposed on a circumferential portion of the ceiling type air conditioner to adjust a temperature and moisture of the indoor space.

FIG. 1 is a cross-sectional view illustrating an inner structure of an indoor unit of a ceiling type air conditioner according to a related art.

Referring to FIG. 1, an indoor unit 10 of a ceiling type air conditioner according to the related art may include a case 20 installed in a ceiling and a turbo fan 30 accommodated within the case 20 and including a plurality of blades 31. The turbo fan 30 may be driven by a motor 32 providing a power. The motor 32 may be attached to a predetermined plate (not shown) to drive the turbo fan 30.

The plate (not shown) may be manufactured using a specific material or having a predetermined shape to reduce noise and vibration generated when vibration of the motor 32 is transferred into the case 20. A suction hole 50 suctioning indoor air may be defined in a center of the indoor unit 10, and a plurality of discharge holes 60 may be defined outside the suction hole 50.

When the indoor unit 10 operates for a predetermined time, the motor 32 may increase in temperature. Thus, cooling passages 80 spaced a predetermined distance from each other may be defined in a bottom surface of the case between the turbo fan 30 and a side surface of the case 20.

Hereinafter, an operation of the ceiling type air conditioner according to the related art will be described.

When the indoor unit 10 of the ceiling type air conditioner operates, the motor 32 may operate to drive the turbo fan 30. Also, the indoor air suctioned through the suction hole 50 may be suctioned into the center of the turbo fan 30 by the driving of the turbo fan 30.

The suctioned indoor air may be heat-exchanged with a heat exchanger 40 disposed to surround the turbo fan 30. The heat-exchanged air may be supplied into the indoor space through the plurality of discharge holes 60 defined in an outer portion of the case 20. Also, the air passing through the blades 31 may be introduced into the motor 32 through the cooling passage 80.

However, if the cooling passage 80 has a wide width, the air introduced into the cooling passage 80 through separation from a main flow of the air discharged toward the heat exchanger 40 may cause turbulence. The turbulence may cause noise, and also deteriorate a function of the ceiling type air conditioner.

As disclosed in Patent Application No. 10-2006-0135877 and shown in FIG. 1 of this application, if the cooling passage 80 has a narrow width, it may be difficult to sufficiently cool heat generated in the motor 32. Thus, operation performance of the turbo fan 30 may be deteriorated.

Also, when the air suctioned through the suction hole 50 passes through the heat exchanger 40, air passing through an upper portion of the heat exchanger 40 may have a wind speed different from that of air passing through a lower portion of the heat exchanger 40. That is, according to the characteristics of the ceiling type air conditioner, since the motor 32 of the indoor unit 10 is attached to the ceiling, the turbo fan 30 should be fixed to an upper end of the air conditioner. Thus, flow rates at the upper and lower portions of the heat exchanger 40 may be non-uniformly distributed.

Thus, when the air passing through the heat exchanger 40 is discharged through the discharge holes 60, an amount of air discharged through the discharge holes 60 may be reduced to deteriorate performance of the indoor unit 10.

SUMMARY

Embodiments provide a ceiling type air conditioner in which wind speeds of air passing through an upper portion of a heat exchanger and air passing through a lower portion of the heat exchanger are uniform when the air suctioned through a suction hole passes through the heat exchanger.

In one embodiment, a ceiling type air conditioner includes: a case defining an outer appearance; a fan motor disposed to a bottom surface of the case, a turbo fan disposed within the case, the turbo fan including a main plate rotated by power provided from the fan motor and a blade having a side connected to the main plate; a heat exchanger disposed outside the turbo fan, wherein a cooling passage cooling the fan motor is defined between the main plate and the bottom surface of the case, and wherein the cooling passage includes: a flow part through which air passing through the blade flows into the flow part toward the fan motor; and a panel installation part to which a panel is installed for adjusting an amount of air flowing into the flow part toward the fan motor.

The details of one or more embodiments are set forth in the accompanying drawings and the description below. Other features will be apparent from the description and drawings, and from the claims.

DETAILED DESCRIPTION OF THE EMBODIMENTS

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Figure 1:
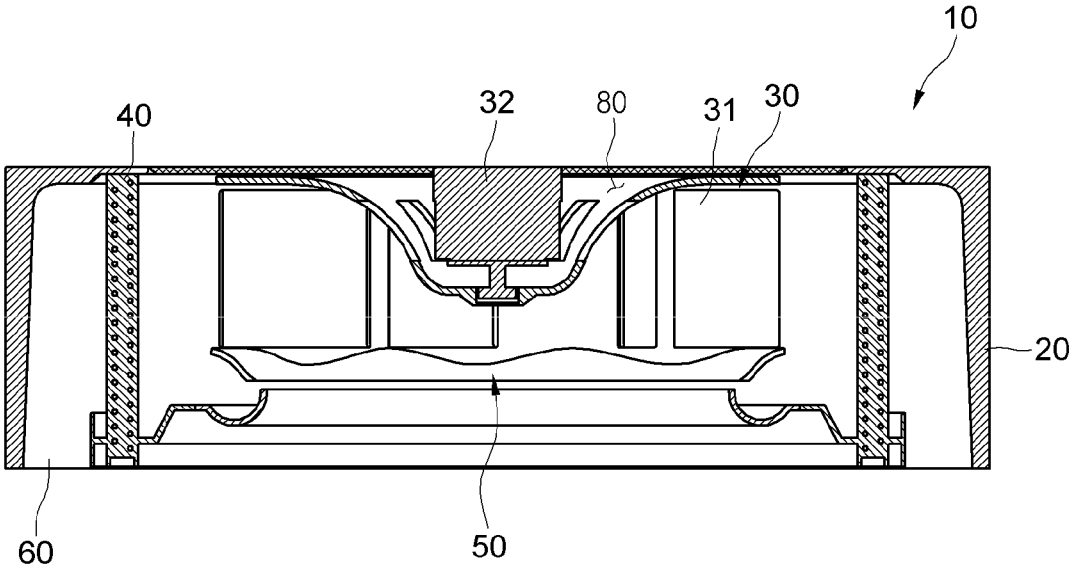
FIG. 1 is a cross-sectional view illustrating an inner structure of an indoor unit of a ceiling type air conditioner according to a related art.
Figure 2:
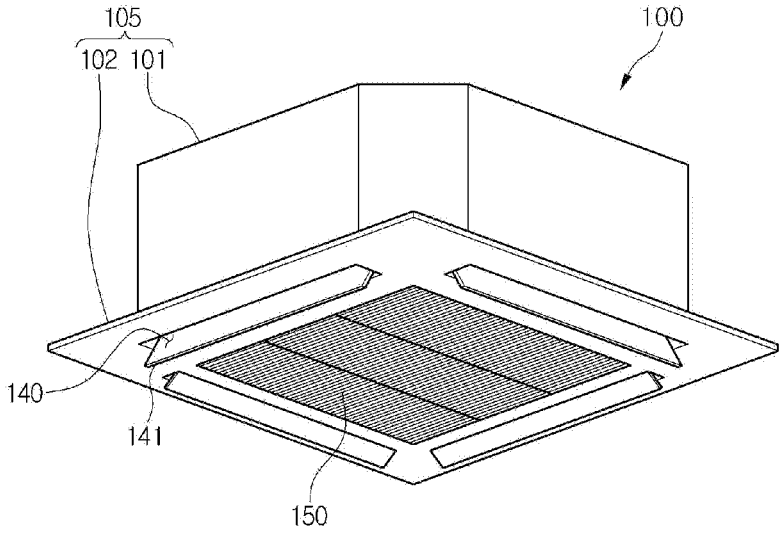
FIG. 2 is a perspective view illustrating an indoor unit of a ceiling type air conditioner according to an embodiment.
Figure 3:
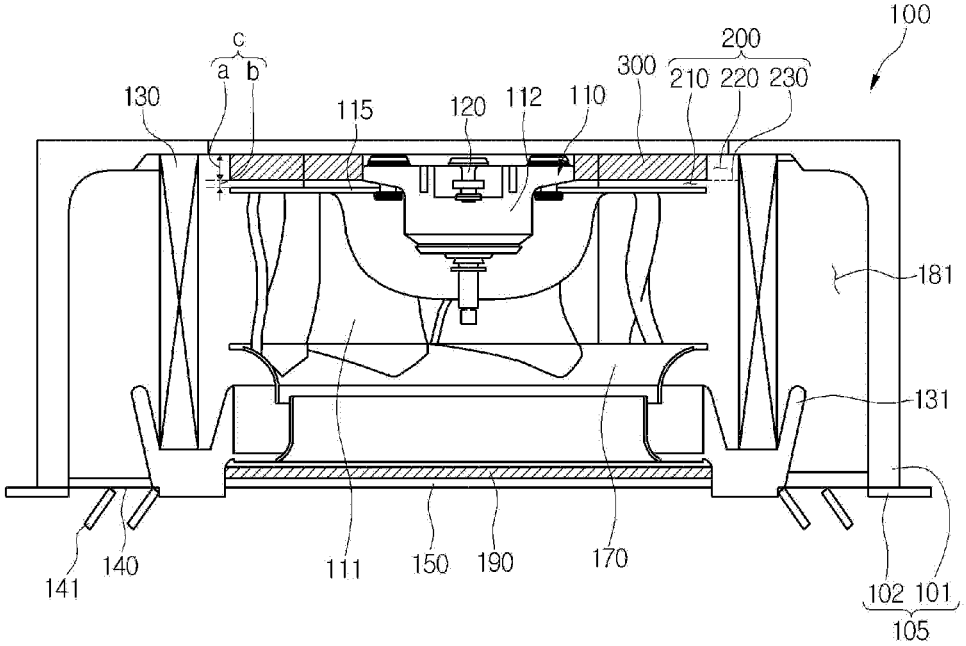
FIG. 3 is a cross-sectional view illustrating the indoor unit of the ceiling type air conditioner according to an embodiment.

FIG. 2 is a perspective view illustrating an indoor unit of a ceiling type air conditioner according to an embodiment, and FIG. 3 is a cross-sectional view illustrating the indoor unit of the ceiling type air conditioner according to an embodiment.

Referring to FIGS. 2 and 3, a ceiling type air conditioner according to an embodiment may include an outdoor unit (not shown) installed in an outdoor space, an indoor unit 100 installed in an indoor space, and a refrigerant tube (not shown) connecting the outdoor unit (not shown) to the indoor unit 100 to allow a refrigerant to flow therethrough.

The indoor unit 100 may include a case 105 defining an outer appearance thereof, a turbo fan 110 disposed within the case 105, a fan motor 120 coupled to the turbo fan 110 to provide power, and a heat exchanger 130 disposed outside the fan motor 120.

The case 105 may include a main body 101 defining side surfaces thereof and a front panel 102 coupled to the main body 101 to define a front surface thereof.

Also, the main body 101 is installed in an indoor ceiling. The main body 101 may have an opened lower portion to communicate with a suction hole 150 defined in the front surface of the front panel 102. Although the main body 101 is installed in the indoor ceiling in consideration of space availability or a sense of beauty, the installed location of the main body 101 is not limited thereto. For example, the main body 101 may be installed in an indoor sidewall.

The front panel 102 may be detachably coupled to the lower portion of the main body 101. Also, the front panel 102 may be exposed to the indoor space so that air is suctioned into or discharged from the indoor unit 100. The front panel 102 may cover the opened portion of the main body 101. For example, the front panel 102 may have a square plate shape to cover the opening of the main body 101. Also, the front panel 102 may include a suction hole 150 through which indoor air is suctioned and a discharge hole 140 through which air is discharged into the indoor space.

The suction hole 150 may be defined in a central portion of the front panel 102. The discharge holes 140 may be symmetrically defined in four sides surrounding the suction hole 150. The suction hole 150 may have a grill structure. Each of the discharge holes 140 may have a rectangular structure with a predetermined width and length. However, each of the suction hole 150 and the discharge holes 140 are not limited to a shape thereof.

Also, a filter 190 for removing various foreign substances contained in the air suctioned into the main body 101 through the suction hole 150 may be provided inside the front panel 102.

The turbo fan 110 may include a hub 112 connected to a rotation shaft of the fan motor 120, a main plate 115 rotated by the fan motor 120, a plurality of blades 111 having one ends connected to the main plate 115 and arranged at a predetermined distance along a circumferential direction on the main plate 115, and a shroud 170 facing the main plate 115 to connect the other ends of the plurality of blades 111 to the shroud 170. The shroud 170 may guide an inflow of air into the suction hole 150 when the turbo fan 110 rotates.

The turbo fan 110 may be disposed on a position corresponding to the suction hole 150 to improve suction efficiency of the air suctioned into the main body 101. Particularly, as shown in FIG. 3, the turbo fan 110 may be disposed to correspond to a vertical direction of the suction hole 150.

Also, the turbo fan 110 may blow the indoor air suctioned through the suction hole 150 toward the heat exchanger 130.

The heat exchanger 130 may surround the outside of the turbo fan 110. For example, the heat exchanger 130 may have a square structure corresponding to a shape of each of the side surfaces of the main body 101. The heat exchanger 130 may heat-exchange with the air suctioned into the main body 101 through the turbo fan 110. Particularly, when the ceiling type air conditioner operates in a cooling mode, air passing through the heat exchanger 130 may decrease in temperature. On the other hand, when the ceiling type air conditioner operates in a heating mode, air passing through the heat exchanger 130 may increase in temperature.

A drain plate 131 accommodating condensed water generated when the refrigerant passing through the heat exchanger 130 is heat-exchanged with the indoor air may be disposed under the heat exchanger 130. Also, a drain tube (not shown) for discharging the condensed water collected in the drain plate 131 to the outside may be connected to the drain plate 131.

A guide passage 181 for guiding a flow direction of air may be defined in an outer portion of the inside of the main body 101. Particularly, the guide passage 181 may guide the air heat-exchanged with the heat exchanger 130 toward the discharge hole 140.

A vane 141 for controlling the flow direction of the air may be disposed in the discharge hole 140. The vane 141 may be rotatable at a predetermined angle. Also, the vane 141 may be inclined outward from the front surface of the front panel 102. This is done for providing air having a uniform wind speed to all indoor portions. However, the rotation direction of the vane 141 is not limited thereto. Also, the vane 141 is not limited to an arrangement, configuration, and operation method as described thereof.

Also, in the ceiling type air conditioner according to the current embodiment, a cooling passage 200 cooling heat generated in the fan motor 120 may be defined. Particularly, the cooling passage 200 may be defined in a space between a bottom surface of the case 105 and the main plate 115. When viewed in FIG. 3, the bottom surface of the case 105 may be defined as one surface of the main body 101 fixing the fan motor 120.

A plurality of air circulation holes (not shown) may be defined in the hub 112 of the fan motor 110. Thus, a portion of air discharged in a radius direction of the turbo fan 110 may flow along the cooling passage 200 defined in a rear surface of the turbo fan 110. Also, since the air flowing into the cooling passage 200 passes through the air circulation holes (not shown) to flow into the fan motor 120, the fan motor 120 may be continuously cooled.

The cooling passage 200 includes a flow part 210 providing a moving path of air introduced into the fan motor 120, a panel installation part 220 above the flow part 210 and located at the bottom surface of the case 105, and an extension part 230 that is a surface defined when a surface on which the panel installation part 220 and the flow part 210 meet extends parallel to the main plate 115.

The bottom surface of the case 105 may be disposed parallel to the main plate 115. Also, the bottom surface of the case 105 may be defined as one surface of the case 105 to which the fan motor 120 is fixed.

The flow part 210 may be disposed below the extension part 230, and the panel installation part 220 may be disposed above the extension part 230.

Also, when viewed from the fan motor 120 toward the heat exchanger 130, each of the panel installation part 220 and the flow part 210 may have a constant width.

If a width of the panel installation part 220 is "a", and a width of the flow part 210 is "b", a width of the cooling passage 200 may be the sum of the width "a" and the width "b".

A portion of air passing through the blades 111 may flow into the fan motor 120 via the width "b". However, if the width "b" is greater than a predetermined value, an amount of turbulence generated when the air is separated from a main flow of air discharged in a direction of the heat exchanger 130 may increase. The turbulence may cause noise.

On the other hand, if the width "b" is less than the predetermined value, it may be difficult to sufficiently cool heat generated in the fan motor 120.

The width "a" of the panel installation part 220 may be greater than that the width "b" of the flow part 210. That is, the width "b" of the flow part 210 may have a size in which an amount of air enough to cool the fan motor 120 passes. Thus, the width "b" of the flow part 210 may be less than that the width "a" of the panel installation part 220.

That is, the width "b" of the flow part 210 may be sufficient to cool the fan motor 120.

In the ceiling type air conditioner according to an embodiment, the width "c" of the cooling passage 200 may increase when compared to that of a cooling passage according to the related art. That is to say, the turbo fan 110 may be disposed spaced a predetermined distance from the bottom surface of the case 105.

The panel 300 may be disposed on the panel installation part 220 so that the width "c" of the cooling passage corresponds to the constant value.

Hereinafter, a detailed structure of the panel 300 will be described.

FIGS. 4(*a*) and 4(*b*) are views of shapes of the panel according to an embodiment.

Figure 4A:
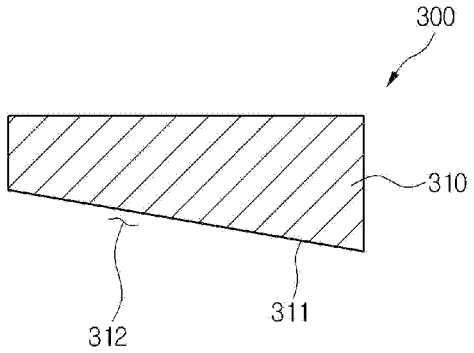
FIGS. 4(*a*) and 4(*b*) views of shapes of a panel according to an embodiment.

Referring to FIG. 4A, the panel 300 may include a body 310 and an inclined part 311 defining one surface of the body 310. The inclined part 311 may be inclined at a predetermined angle with respect to the main plate 115.

The inclined part 311 may be inclined in a direction in which the body 310 is spaced apart from the fan motor 120.

That is, the inclined part 311 may be inclined in one direction with respect to the direction oriented from the fan motor 120 toward the heat exchanger 130.

That is to say, with respect to the direction oriented from the fan motor 120 toward the heat exchanger 130, the flow part 210 may gradually increase in width.

A flow of air flowing along the panel 300 will be described below.

One portion of the air passing through the blades 111 may pass through the heat exchanger 130 and then be discharged into the indoor space through the discharge hole 140. Also, another portion of the air passing through the blades 111 may flow into the fan motor 120 along the flow part 210.

However, the panel 300 is disposed on the top surface of the flow part 210. That is, the air flowing into the flow part 210 may contact the inclined part 311 defined on one surface of the panel 300. Thus, the air flowing along the inclined part 311 may not flow into the fan motor 120 due to friction force, but flow back into the heat exchanger 130. That is, an eddy generation part 312 may be formed on the inclined part 311. Thus, an amount of air passing through the flow part 210 may be reduced by eddy generated in the eddy generation part 312.

To increase the friction force between the air flowing along the inclined part 311 and the inclined part 311, when viewed from the fan motor 120 toward the heat exchanger 130, the flow part 210 may be disposed to gradually increase the width thereof.

Figure 4B:
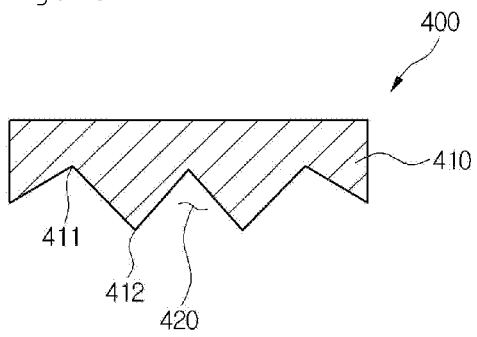

Similarly, referring to FIG. 4B, a panel 400 may include a body 410, a protrusion 412 disposed on one surface of the body 410 to protrude by a predetermined length, and a groove 411 defined in one surface of the body 410 and recessed by a predetermined depth.

The protrusion 412 and the groove 411 may be alternately disposed. Also, each of the protrusion 412 and the groove 411 may be provided in plurality.

Air passing through the blades 111 to flow along the flow part 210 may generate eddy on the groove 411. That is, an eddy generation part 411 may be formed in the groove 411. Thus, an amount of air passing through the flow part 210 may be reduced by the eddy generated in the eddy generation part 420.

However, the present disclosure is not limited to the structures of the panels 300 and 400. For example, various structures may be applied to the panels 300 and 400.

Hereinafter, an operation process of the ceiling type air conditioner according to an embodiment will be described.

Figure 5:
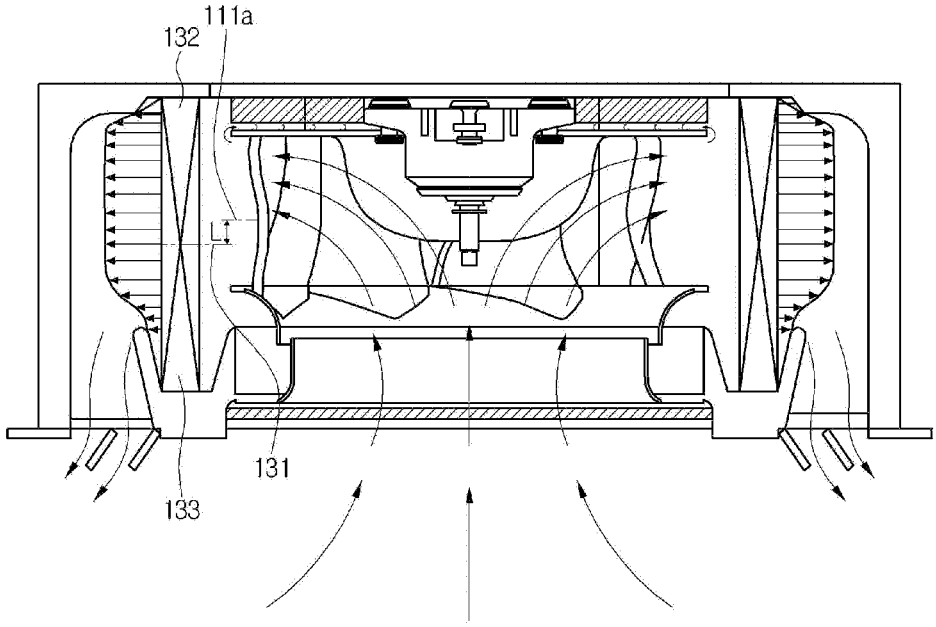
FIG. 5 is a schematic view illustrating a flow of air passing through the ceiling type air conditioner according to an embodiment.

FIG. 5 is a schematic view illustrating a flow of air passing through the ceiling type air conditioner according to an embodiment.

FIG. 5 is a view illustrating a flow of air on the basis of the structure of FIG. 3. Thus, the same structure as that of FIG. 3 will be expressed with the same reference numeral.

Referring to FIG. 5, when the ceiling type air conditioner according to an embodiment operates, the indoor unit 100 connected to the outdoor unit (not shown) may operate. When the indoor unit 100 operates, the main plate 115 may rotate by driving of the fan motor 120. As the main plate 115 rotates, the plurality of blades 111 connected to the main plate 115 may also rotate. When the plurality of blades 111 rotate, indoor air may be suctioned through the suction hole 150 defined in the center of the front panel 102 of the indoor unit 100. The suctioned air may pass through the filter 190 to filter foreign substances. Also, a flow of the suction air may be guided into the turbo fan 110 by the shroud 170.

The air introduced into the turbo fan 110 may be radially discharged by the rotation of the plurality of blades 111. That is, the air introduced into a lower portion of the turbo fan 110 may be discharged in a lateral direction by the operation of the turbo fan 110.

One portion of the air discharged from the blades 111 may pass through the heat exchanger 130 and then be heat-exchanged with a refrigerant. Also, another portion of the air discharged from the blades 111 may flow into the flow part 210.

Here, the turbo fan 110 may be spaced a predetermined distance from the bottom surface of the main body 101. That is, a vertical distance "L" from a central point 111*a* of the blades 111 to a central point 131 of the heat exchanger 130 may be within a predetermined value.

Particularly, the heat exchanger 130 may include an upper heat exchanger 132 disposed at an upper side with respect to the central point 131 of the heat exchanger 130 and a lower heat exchanger 133 disposed at a lower side. Then, the predetermined value may be defined as a valve in which a mean wind speed value of air passing through the upper heat exchanger 132 and a mean wind speed value of air passing through the lower heat exchanger are within a uniform range.

The uniform range may be a range defined as a wind speed of air passing through the upper heat exchanger 132 is the same or substantially same as that of air passing through the lower heat exchanger 133. The present disclosure is not limited to the particular uniform range.

For example, when viewed from the bottom surface of the case 105 toward the main plate 115, a surface connecting the central point of the blades 111 to the central point of the heat exchanger 130 may be disposed parallel to the main plate 115. In the current embodiment, a wind speed of the air passing through the upper heat exchanger 132 and a wind speed of the air passing through the lower heat exchanger 133 may be the same.

A panel 300 may be disposed above the flow part 210. Thus, a portion of the air flowing into the flow part 210 may generate eddy due to the panel 300. Thus, an amount of air flowing into the fan motor 120 may be reduced by the eddy.

That is to say, in the ceiling type air conditioner according to related art, a wind speed of air passing through the upper heat exchanger 132 is greater than that of air passing through the lower heat exchanger 133. In contrast, in the ceiling type air conditioner according to the current embodiment, each of the blades 111 may be adjusted in position to uniformly adjust the wind speeds of the air passing through the upper heat exchanger 132 and the lower heat exchanger 133.

Also, the air passing through the blades 111 may have a pressure greater than that of air passing through the cooling passage 220. Also, when each of the blades 111 is adjusted in position, the cooling passage 200 may increase in width.

Thus, to reduce the width of the cooling passage 200, in the ceiling type air conditioner according to the current embodiment, the panels 300 and 400 may be disposed on the cooling passage 200 to optimize the performance.

That is, an amount of air passing through the cooling passage 200 may be sufficient if the air sufficiently cools the fan motor 120. In general, the amount of air may be small. Thus, since the eddy generated by the panel 300 causes air to flow into the flow part 210 to flow back into the heat exchanger 130, the performance of the cooling passage 200 may be maintained. Also, since the amount of air introduced into the fan motor 120 is adjusted by the panel 300, noise generated when the air passes through the cooling passage 200 to flow into the fan motor 120 may be minimized.

The air passing through the heat exchanger 130 by the panel 300 may also pass through the discharge hole 140 to condition the indoor air.

Also, the plurality of vanes 141 may be disposed in the discharge hole 140 to adequately condition the indoor space.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A ceiling type air conditioner comprising:

a case defining an outer appearance;

a fan motor disposed to a bottom surface of the case;

a turbo fan disposed within the case, the turbo fan comprising a main plate rotated by power provided from the fan motor and a blade having a side connected to the main plate;

a heat exchanger disposed outside the turbo fan, wherein a cooling passage cooling the fan motor is defined between the main plate and the bottom surface of the case, and wherein the cooling passage comprises:

a flow part through which air passing through the blade flows into the flow part toward the fan motor;

a panel installation part to which a panel is installed to adjust an amount of air flowing into the flow part toward the fan motor; and an extension part that is a surface defined when a surface on which the panel installation part and the flow part meet each other extends parallel to the main plate, wherein the panel installation part is disposed above the extension part and the flow part is disposed under the extension part.

2. The ceiling type air conditioner according to claim 1, wherein the bottom surface of the case is parallel to the main plate.

3. The ceiling type air conditioner according to claim 2, wherein a height of the panel installation part is greater than that of the flow part.

4. The ceiling type air conditioner according to claim 3, wherein the height of each of the panel installation part and the flow part is constant.

5. The ceiling type air conditioner according to claim 1, wherein the panel comprises:

a body; and an inclined part defining one surface of the body, wherein an eddy generation part is formed on the inclined part generating an eddy in the air passing through the flow part toward the fan motor.

6. The ceiling type air conditioner according to claim 5, wherein, when viewed from the fan motor toward the heat exchanger, the inclined part is inclined in one direction.

7. The ceiling type air conditioner according to claim 6, wherein, when viewed from the fan motor toward the heat exchanger, the flow part has a gradually increasing width.

8. The ceiling type air conditioner according to claim 1, wherein the panel comprises:

a body;

a projection disposed on one surface of the body to protrude by a length; and a groove defined in one surface of the body and recessed by a depth, wherein an eddy generation part generating an eddy in air passing through the flow part is formed in the groove.

9. The ceiling type air conditioner according to claim 8, wherein each of the projection and the groove is provided in plurality, and the plurality of projections and the plurality of grooves are alternately disposed with respect to each other.

10. The ceiling type air conditioner according to claim 2, wherein, in an axial cross-sectional view, from the bottom surface of the case toward the main plate, a line connecting a vertically central point of the blade to a vertically central point of the heat exchanger is disposed parallel to the main plate.

11. The ceiling type air conditioner according to claim 2, wherein, in an axial cross-sectional view, from the bottom surface of the case toward the main plate, a vertical distance between a central point of the blade and a central point of the heat exchanger is within a predetermined value.

12. The ceiling type air conditioner according to claim 11, wherein the heat exchanger comprises an upper heat exchanger disposed at an upper side with respect to the central point of the heat exchanger and a lower heat exchanger disposed at a lower side, and the predetermined value is a value within a range in which a wind speed mean value of air passing through the upper heat exchanger and a wind speed mean value of air passing through the lower heat exchanger are uniform.

13. A ceiling type air conditioner comprising:

a case defining an outer appearance;

a fan motor disposed to a bottom surface of the case;

a turbo fan disposed within the case, the turbo fan comprising a main plate rotated by power provided from the fan motor and a blade having a side connected to the main plate;

a heat exchanger disposed outside the turbo fan, wherein a cooling passage cooling the fan motor is defined between the main plate and the bottom surface of the case, and wherein the cooling passage comprises:

a flow part through which air passing through the blade flows into the flow part toward the fan motor; and a panel installation part to which a panel is installed to adjust an amount of air flowing into the flow part toward the fan motor, wherein the panel comprises a body and an inclined part defining one surface of the body, and wherein, when viewed from the fan motor toward the heat echanger, the flow part has a gradually increasing width.

14. A ceiling type air conditioner comprising:

a case defining an outer appearnace;

a fan motor disposed to a bottom surface of the case;

a turbo fan disposed within the case, the turbo fan comprising a main plate rotated by power provided from the fan motor and a blade having a side connected to the main plate;

a heat exchanger disposed outside the turbo fan, wherein a cooling passage cooling the fan motor is defined between the main plate and the bottom surface of the case, and wherein the cooling passage comprises:

a flow part through which air passing through the blade flows into the flow part toward the fan motor;

a panel installation part to which a panel is installed to adjust an amount of air flowing into the flow part toward the fan motor; and wherein the panel comprises a body; a projection disposed on one surface of the body to protrude by a length; and a groove defined in one surface of the body and recessed by a depth, wherein an eddy generation part generating an eddy in air passing through the flow part is formed in the groove.

15. A ceiling type air conditioner comprising:

a case defining an outer appearance;

a fan motor disposed to a bottom surface of the case;

a turbo fan disposed within the case, the turbo fan comprising a main plate rotated by power provided from the fan motor and a blade having a side connected to the main plate;

a heat exchanger disposed outside the turbo fan, wherein a cooling passage cooling the fan motor is defined between the main plate and the bottom surface of the case, and wherein the cooling passage comprises:

a flow part through which air passing through the blade flows into the flow part toward the fan motor; and a panel installation part to which a panel is installed to adjust an amount of air flowing into the flow part toward the fan motor, wherein the main plate is spaced apart from the bottom surface of the case downward, and the panel contacts with the bottom surface of the case and extends downward, and wherein the flow part is defined between a bottom of the panel and the main plate.

* * * * *